US011701660B2

(12) United States Patent
Pala

(10) Patent No.: US 11,701,660 B2
(45) Date of Patent: Jul. 18, 2023

(54) SPECIMEN SAMPLE COLLECTION DEVICE WITH BUFFER-CONTAINING CAP

(71) Applicant: Clinical Reference Laboratoy Inc., Lenexa, KS (US)

(72) Inventor: Serhat Pala, San Diego, CA (US)

(73) Assignee: Clinical Reference Laboratory, Inc., Lenexa, KS (US)

( * ) Notice: Subject to any disclaimer, the term of this patent is extended or adjusted under 35 U.S.C. 154(b) by 0 days.

(21) Appl. No.: 17/423,448

(22) PCT Filed: Jul. 27, 2020

(86) PCT No.: PCT/US2020/043791

§ 371 (c)(1),
(2) Date: Jul. 15, 2021

(87) PCT Pub. No.: WO2021/021764

PCT Pub. Date: Feb. 4, 2021

(65) Prior Publication Data

US 2022/0143601 A1 May 12, 2022

Related U.S. Application Data

(60) Provisional application No. 62/879,437, filed on Jul. 27, 2019.

(51) Int. Cl.
*B01L 3/00* (2006.01)
*B65D 51/28* (2006.01)

(52) U.S. Cl.
CPC ..... *B01L 3/50825* (2013.01); *B65D 51/2835* (2013.01); *B01L 2200/16* (2013.01); *B01L 2300/044* (2013.01); *B01L 2300/047* (2013.01); *B01L 2300/0672* (2013.01)

(58) Field of Classification Search
CPC ..... B01L 3/50825; B01L 2200/16; B01L 2300/044; B01L 2300/047; B01L 2300/0672; B65D 51/2835
USPC ..... 422/550
See application file for complete search history.

(56) References Cited

U.S. PATENT DOCUMENTS 3,378,168 A 4/1968 Hildenbrant
4,795,043 A 1/1989 Odet et al.
7,882,976 B1 * 2/2011 Goede ..... B65D 51/2835 220/258.1

(Continued)

FOREIGN PATENT DOCUMENTS

WO WO-2004033336 A1 * 4/2004 ..... B65D 51/2835
WO WO-2010125404 A1 * 11/2010 ..... B01L 3/502

*Primary Examiner* — Matthew D Krcha
*Assistant Examiner* — Jacqueline Brazin
(74) *Attorney, Agent, or Firm* — CP Law Group PC; Cy Bates

(57) ABSTRACT

A specimen sample collection device is disclosed, the device including: a base having a neck extending therefrom, a film-puncture element disposed within the neck, and one or more fluid ports extending through the base within the neck; a cap engaged with the neck, the cap comprising a film attached about an inner cylinder of the cap along a periphery thereof; wherein the film defines a buffer-containing cavity within the cap, and wherein the buffer-containing cavity is configured to hold a preservation buffer for preserving a sample stored within a collection reservoir of the device.

15 Claims, 5 Drawing Sheets

(56) References Cited

U.S. PATENT DOCUMENTS

| | | | | |
|---|---|---|---|---|
| 2005/0236424 | A1* | 10/2005 | Walters | B65D 51/2835 222/83 |
| 2008/0290061 | A1* | 11/2008 | Seelhofer | B65D 51/2835 215/256 |
| 2009/0216213 | A1 | 8/2009 | Muir et al. | |
| 2010/0168678 | A1 | 7/2010 | Glocker | |
| 2013/0092690 | A1* | 4/2013 | Skakoon | B65D 51/2835 220/277 |
| 2013/0160574 | A1* | 6/2013 | Kacian | B65D 51/002 422/534 |
| 2016/0068319 | A1* | 3/2016 | Friesen | A47J 31/401 220/521 |
| 2018/0036733 | A1 | 2/2018 | Williams | |

* cited by examiner

SPECIMEN SAMPLE COLLECTION DEVICE WITH BUFFER-CONTAINING CAP

TECHNICAL FIELD

This invention relates to devices and methods for chemical, protein and other biomolecule diagnostic testing; and more particularly, to such a device with an integrated buffer-containing cap and related method for field-testing followed by laboratory confirmation-testing.

BACKGROUND ART

There exist a myriad of devices and methods configured for testing saliva of an individual. Such devices and methods in the conventional art are commonly implemented for drug testing, DNA testing (ancestry, health, traits), and other applications. U.S. Pat. No. 7,387,899 to D'Angelo summarizes a background related to saliva collection devices for diagnostic testing; the entire contents of which are hereby incorporated by reference.

While instant tests are commercially available, which are referred to herein as "field-operated tests", "field tests" and the like, and generally include home testing kits for saliva-based diagnostic testing, such tests are limited for instant use only, and cannot be sent to a laboratory for confirmation testing due to bacteria and other components in saliva which can secrete enzymes and degrade the saliva sample, or other limitations, such that later testing cannot be reliably performed.

To obtain a laboratory test concerning a saliva sample, a subject generally must provide the sample at or near the laboratory facility to enable immediate testing prior to sample degradation.

There are many commercial instances where immediate testing is desired, but where laboratory confirmation testing is also desired. For example, drug testing is one application where a subject might desire instant results of a field-test and where an employer or other entity may desire laboratory-provided confirmation testing to ensure the accuracy and quality of testing results. Currently, there are no devices or methods configured to facilitate both immediate field testing and subsequent confirmation testing.

SUMMARY OF INVENTION

Technical Problem

There is currently no specimen sample collection device that is useful as an instant test and further capable of laboratory confirmation of test results. This is problem is largely due to no device being configured with a selectively releasable specimen buffer solution for preserving the specimen sample during translocation from point of acquisition to a laboratory. Indeed, conventional specimen sample collection devices are not fitted with a solution for mixing a buffer solution with a collected sample.

Solution to Problem

In the instant disclosure, a specimen sample collection device with buffer-containing cap is provided. The buffer-containing cap is particularly distinguished from the prior art in that it holds a preservation buffer solution within a buffer-containing cavity within the cap, and comprises a film that is adapted to be punctured for releasing the preservation buffer into the device for mixing with the collected sample and preserving the same, wherein the sample can be preserved for up to several days during translocation from a point of acquisition to a laboratory.

Advantageous Effects of Invention

Using a specimen sample collection device with buffer-containing cap as disclosed herein, an end user may collect a specimen sample, optionally perform or obtain a result of an instant test, and further puncture the buffer-containing cap to release a preservation buffer for mixing with the collected sample and preserving the same for a period of up to several days, which is useful during translocation, for example common shipping or courier service, from the point of acquisition or collection to a laboratory. Once received at the laboratory, the sample can be processed for results confirmation.

The specimen sample collection device may be further enhanced with a software application that can be used to aid in the process of sample collection and providing chain of custody of custody, among other things.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DESCRIPTION OF EMBODIMENTS

Figure 1:
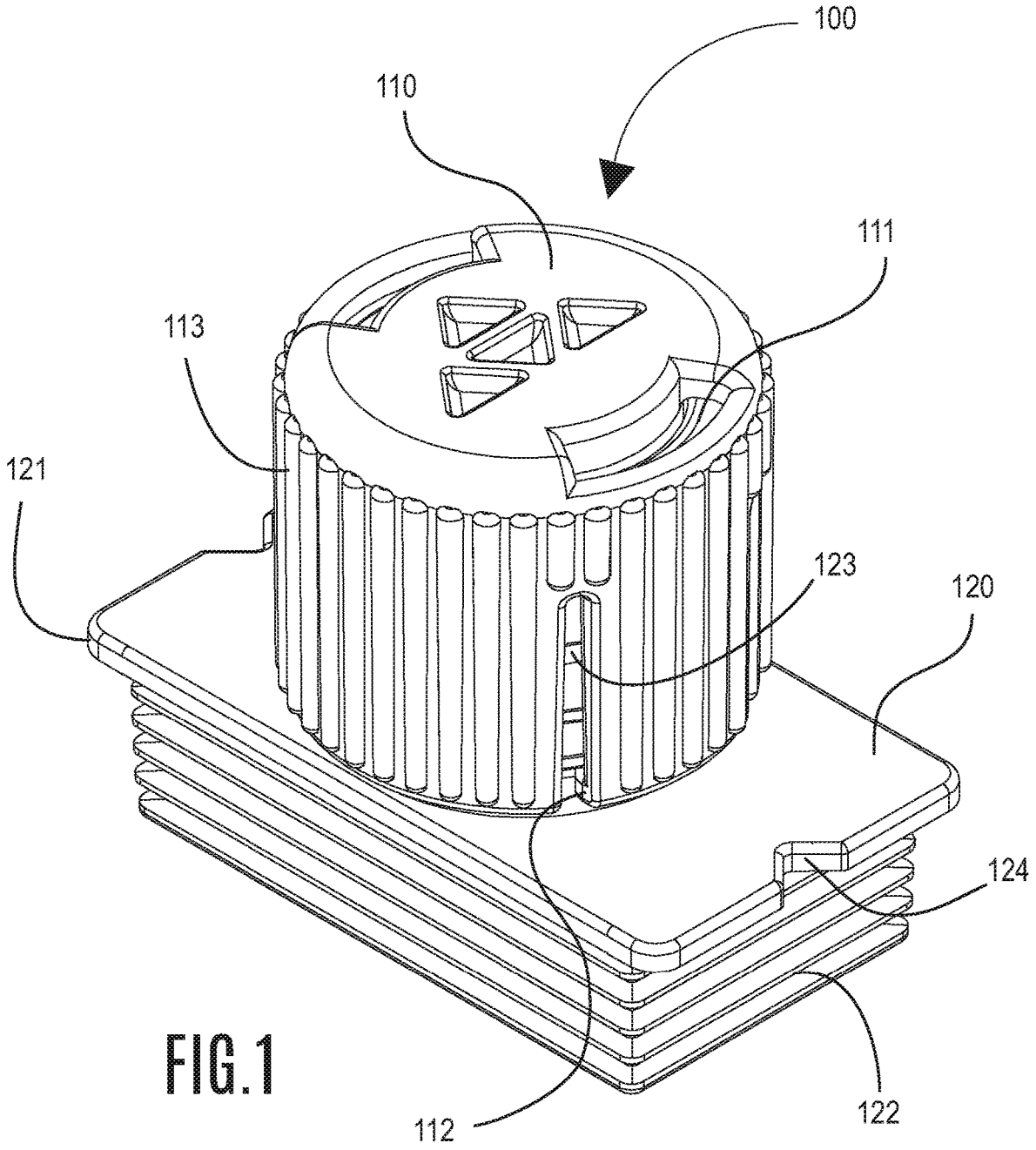
FIG. 1 shows a perspective view of the buffer-containing cap for use with a specimen sample collection device; the cap being in the deployed state (pressed downward relative to the base).

This invention provides a solution to the problems and limitations in the art. Specifically, a specimen sample collection device and related methods are disclosed which are configured to provide instant field-testing results to a user followed by optional subsequent laboratory confirmation of individual identity and/or diagnostic results. In certain embodiments, a device is provided that contains a preservation buffer for preserving the saliva sample for a duration enough to allow for shipping of the sample to a laboratory for performing a subsequent confirmation testing. The device, and a reservoir within a cap of the device, as well as methods for using the device as a saliva collection instrument for performing field and confirmation testing are each described.

The Device

The specimen sample collection device ("device") will be generally described in the context of a saliva sample collection device but may be similarly implemented as a device for collecting urine, blood, hair, or other biological samples. One with skill in the art will appreciate collection methods and a conventional preservation buffer that can be substituted for each of the forgoing specimen sample types.

In an embodiment, a specimen sample collection device, comprises: a base having a neck extending therefrom, a film-puncture element disposed within the neck, and one or more fluid ports extending through the base within the neck; a cap engaged with the neck, the cap comprising a film attached about an inner cylinder of the cap along a periphery thereof; wherein the film defines a buffer-containing cavity within the cap, and wherein the buffer-containing cavity is configured to hold a preservation buffer for preserving a sample stored within a collection reservoir of the device.

In an embodiment, the cap is configured for deployment only upon rotating the cap ninety degrees from a home position to align cap and base alignment features, and pressing the cap toward the base with the cap and base alignment features being in alignment.

In another embodiment, the cap comprises at least one cap engagement feature configured to slideably translate through a channel extending vertically along a portion of the neck.

In another embodiment, the neck comprises one or more threads and a channel configured to restrict deployment of the cap against the base.

In another embodiment, the film-puncture element comprises a slot, wherein the slot is configured to communicate preservation buffer toward the one or more fluid-ports.

In another embodiment, the collection reservoir is removably coupled to the base of the device.

In another embodiment, a sponge collector is coupled to the base at a receiver, the receiver being disposed opposite the film-puncture element.

In another embodiment, the preservation buffer comprises: a detergent, a metal chelator, and a pH buffer.

In yet another embodiment, the preservation buffer comprises: sodium dodecyl sulfate, EDTA, and Tris.

Therefore, in accordance with a preferred embodiment, the device is configured for collecting and preserving a saliva sample as part of an instant saliva testing kit that includes a saliva-preservation buffer configured to preserve the saliva sample for a period of time long enough to allow the saliva sample to be shipped to a laboratory for later testing. The device generally comprises: a testing vessel with regents that can test the saliva and present instant results to an observer, a buffer vessel housed within a cap of the device for storing preservation buffer until it is required to mix with and preserve the saliva sample being collected, a protective seal for isolating the preservation buffer to prevent premature exposure, and a mechanism to break the protective seal for communicating the preservation buffer into a chamber of the device for mixing with the saliva sample and preserving the same.

As shown in FIG. 1, a system (100) is provided having a base (120), the base is configured for integration with a saliva collection device (vessel chamber not shown). The saliva collection device may be configured with conventional instant-test components, such as, but not limited to, capillary action components (not shown) as are commonly used in various diagnostic testing devices, and necessary reagents for providing instant communication of test results to an observer.

As shown, the cap (110) is configured to engage with the base (120), generally with threads (123) although alternative means may be deployed. The cap is rotated to align a cap alignment feature (111) with a base alignment feature (124), wherein, once aligned, the cap can be depressed (without mechanical prevention), such that a film retaining the preservation buffer within a volume of the cap (cap cavity) may be punctured and the preservation buffer released from the cap to flow into a chamber of the device for mixing with the saliva or other specimen sample and preserving the same.

Figure 2:
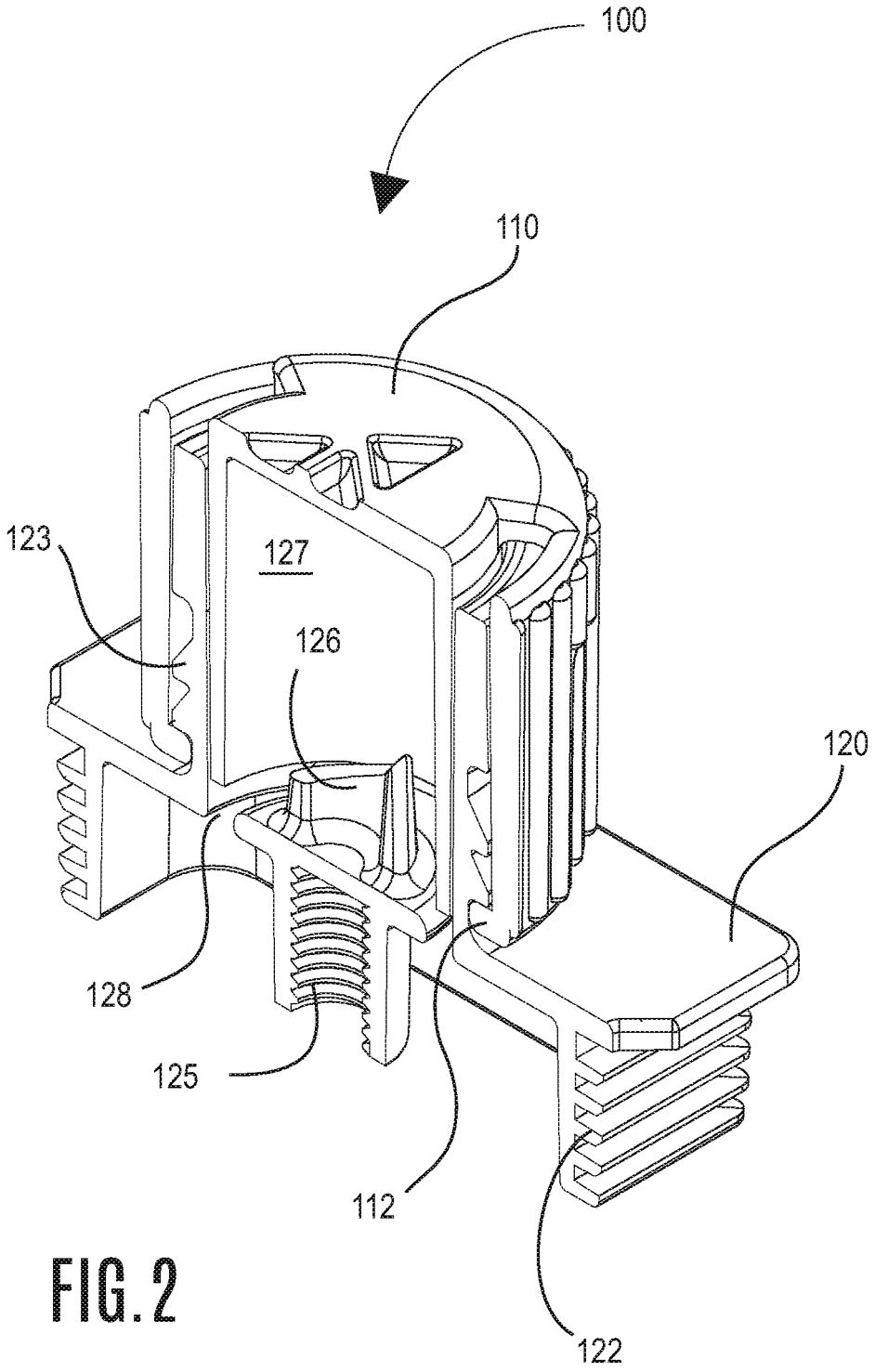
FIG. 2 shows a first section view of the buffer-containing cap for use with the specimen sample collection device, the cap being in the deployed state.

FIG. 2 shows a section view of the system (100) comprising a buffer containing cap (110). The base (120) comprises a means for engaging a saliva collection device ("device-engagement elements 122"). Here, a flange (121) and ribs (122) are illustrated for coupling the system to a collection reservoir; however, friction fitment or other techniques known to one with skill in the mechanical arts, for the purpose of integrating the system with a saliva collection reservoir, may be practiced.

Extending upwardly from the base is a cap engagement feature. Here, the cap (110) is comprises cap engagement feature (112) attached to threads (123); however, similar means may be implemented by one with the ordinary level of skill in the mechanical arts. In the illustrated embodiment, at least one channel and mechanical stoppage elements can be deployed to prevent the cap from translating beyond a vertical threshold relative to the base where the film becomes punctured by the film puncture element (126). In this regard, the cap can be configured to require a ninety-degree rotation prior to advancing downwardly beyond the film-breaking vertical threshold.

Note the interior volume of the cap portion forms a buffer containing cavity (127) that is configured to hold a preservation buffer via a film seal, which is not sown due to the cap being illustrated in the deployed state where the film seal will be broken by the film puncture element (126).

Fluid-ports (128) communicate the preservation buffer as it released from the cavity into a portion of the collection reservoir.

A saliva sponge or other sample collection article may be coupled to the system at receiver (125), in which case the system may be removed from the collection reservoir as a whole, the collection article may be used to gather the sample or the sample may be placed in the reservoir, and the system may be re-attached to the collection reservoir to close the device. One having skill in the art will appreciate a plurality of collection procedures that may be implemented with the device and system as described herein.

In principal, any one of many mechanical embodiments may be designed and practiced without departing from the spirit and scope of the invention; namely, storing a preservation buffer in the cap of the testing device, isolated by a film, which can be punctured when needed to release the preservation buffer into a chamber of the device where saliva is collected and can mix with the preservation buffer for preserving the same.

Figure 3:
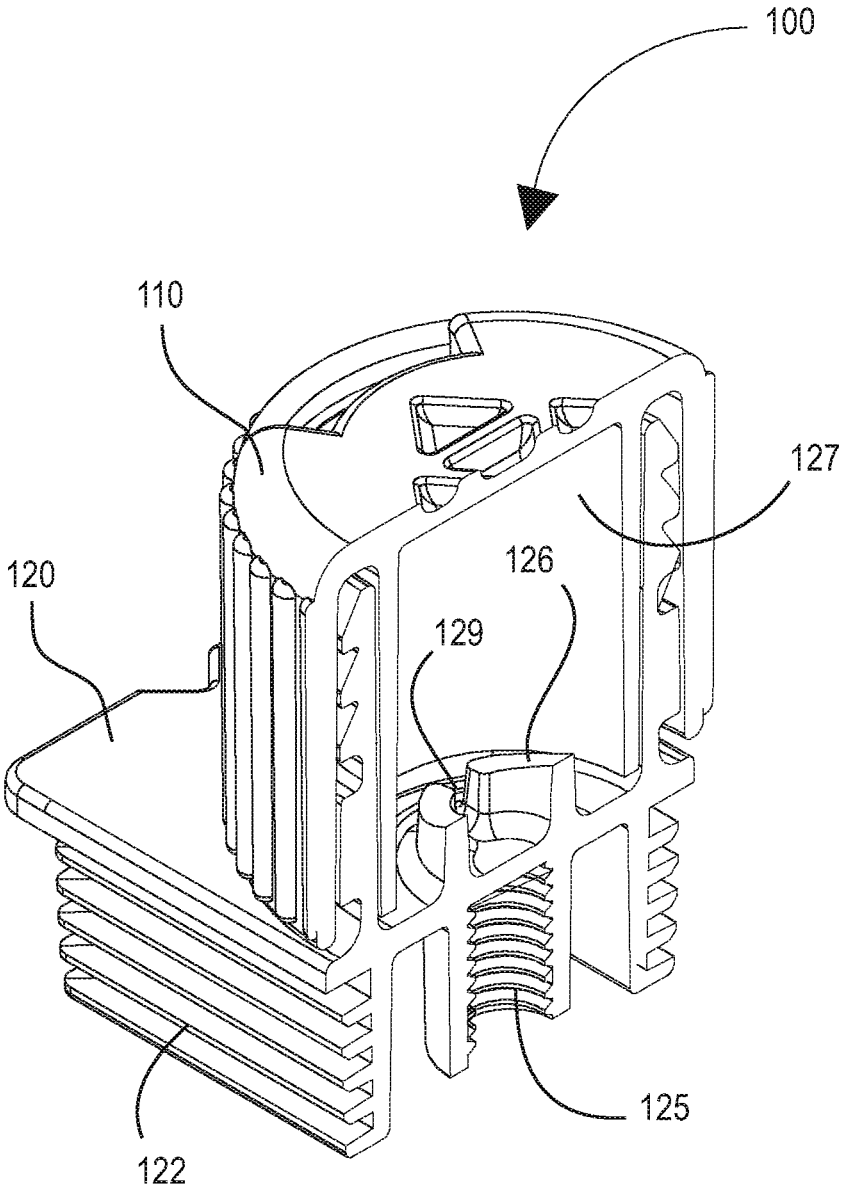
FIG. 3 shows a second section view of the buffer-containing cap, ninety degrees from the first section view, for use with the specimen sample collection device, the cap being in the deployed state.

FIG. 3 shows a second section view of the system with buffer-containing cap, shown ninety degrees from the first section view of FIG. 2, the system being configured for use with the specimen sample collection device, the cap being in the deployed state (translated downwardly toward the base, where the film is punctured and the preservation buffer is released. Here, the film puncture element (126) comprises a slot (129) for guiding the preservation buffer into the fluid-ports (FIG. 2, 128), wherein preservation buffer is communicated from a cavity (127) of the cap, through the slot of the film puncture element, into an area between the base and the cap, and through fluid-ports downwardly via gravitational assistance to reach a final destination in the chamber or collection reservoir where the saliva sample is stored.

The cap comprises cap alignment features, and the base comprises base alignment features. When the cap alignment features are aligned with the base alignment features, the cap is configured to translate past the threshold where the film becomes punctured by the film puncture element as previously described. Reference is made to FIG. 1 which shows these features from an alternative view.

Figure 4:
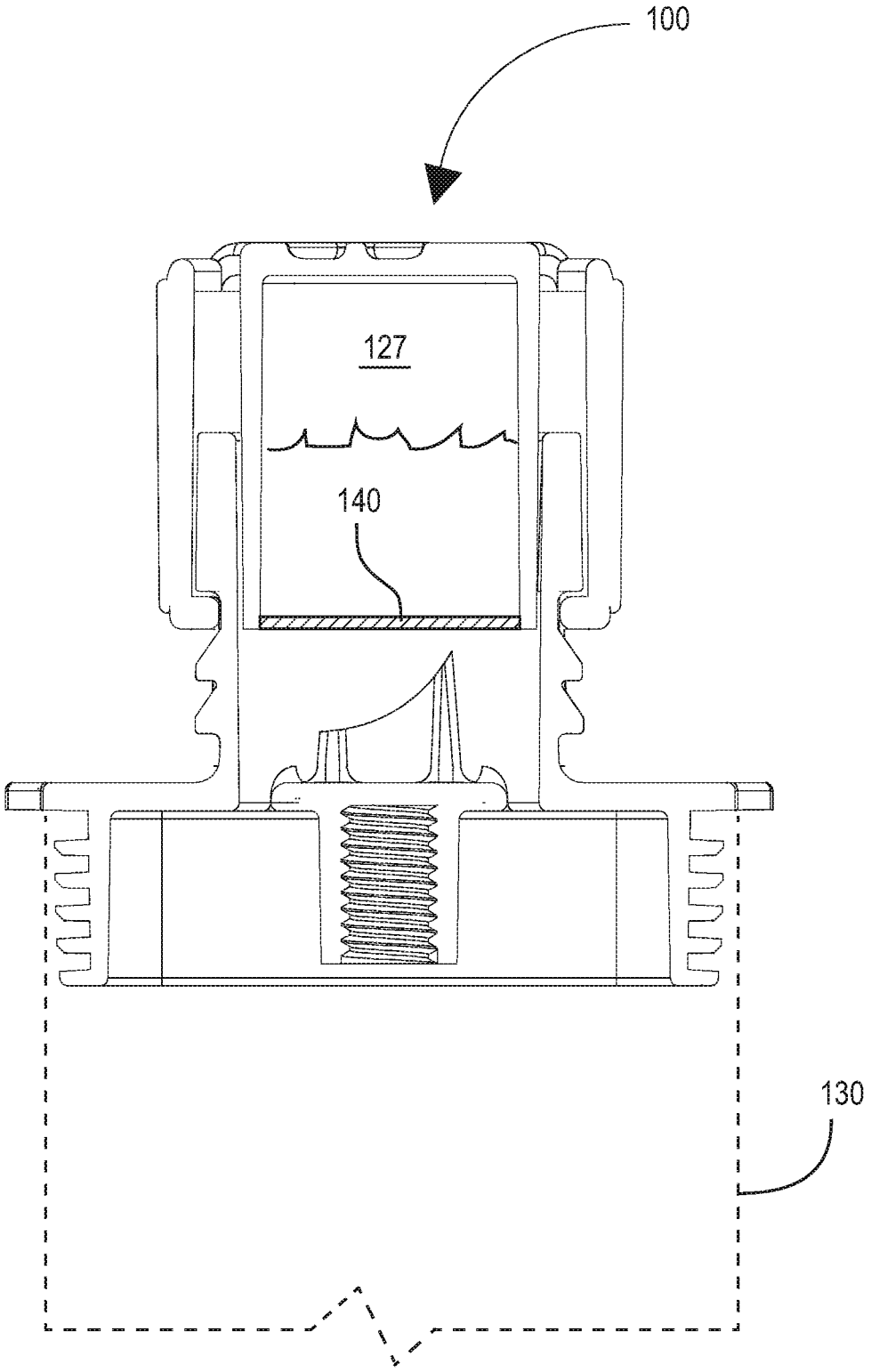
FIG. 4 shows the system with the cap configured in an undeployed state.

FIG. 4 shows the system coupled to the collection reservoir (130), here the system is in the undeployed state, that is, the preservation buffer is contained within the buffer cavity (127) by film (140). In the undeployed state, the cap is vertically positioned with the film being disposed above the film puncture vertical threshold. The cap is rotated ninety degrees to align the cap engagement features such that the cap can translate downwardly for puncturing the film at the film puncture element and thereby releasing the preservation buffer solution into the collection reservoir.

Figure 5:
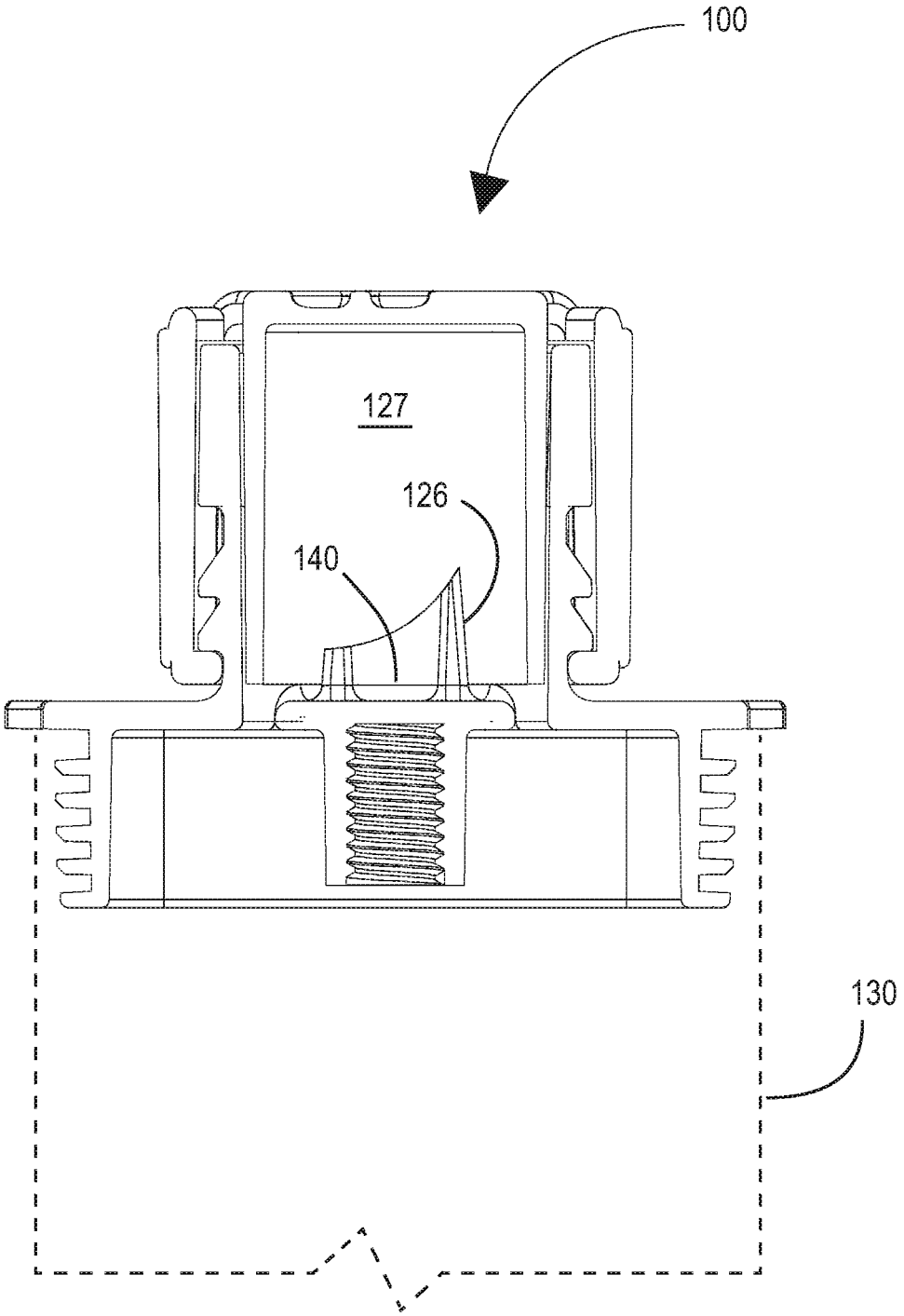
FIG. 5 shows the system with the cap configured in a deployed state.

FIG. 5 further shows the system (100) configured to house and store preservation-buffer for use with a saliva collection device; here the cap is actuated downwardly such that the film (140) is punctured by the film puncturing element (126) thereby releasing the preservation buffer into a portion of the collection reservoir.

Saliva Preservation Buffer

The preservation buffer can be any buffer that preserves a specimen sample, such as a saliva sample, from breakdown such that a diagnostic test can be performed many hours or days after collection.

In a general embodiment, the preservation buffer comprises: a detergent, a metal chelator, and a buffer to maintain correct pH.

For example, in a preferred embodiment, the preservation buffer comprises: 0.5% sodium dodecyl sulfate, 1.0 mM EDTA, and 1.0 mM Tris. This preservation buffer has been shown to be stable at room temperature for at least six months, and when used with saliva functions to preserve the sample at room temperature for subsequent analysis. Other preservation buffer as would be appreciated by one with skill in the art can be similarly implemented.

Use of the Device and Integrated System

The subject, or administrator of the test, hereinafter "tester", takes the saliva collection sponge out of the testing vessel (device) and has the sample donor place it in their mouth to collect saliva.

Once the required amount of saliva is gathered, the tester places the saliva collection sponge in the testing vessel and enacts the test by releasing the regents so they can contact the oral fluid (saliva). They then wait for the appropriate amount of time for the reagents to function and the test to return a result.

If, for whatever reason, the tester, the subject, or a third party requester wants to send the saliva sample to a laboratory for confirmation testing, they can twist the cap, within which the preservation buffer liquid is contained, and push down to break the protective seal (film), thus releasing the preservation buffer into the chamber to surround the saliva collection sponge.

The preservation buffer serves to preserve the saliva sample and keep it safe from breaking down for approximately 14 days, and in some instances up to 90 days or more, which can be enough time to ship the preserved sample to a laboratory or elsewhere to process for confirmation testing.

Neither the regents, nor the preservation buffer, will negatively affect the saliva sample. The saliva sample will be testable by laboratory equipment.

The Process

The process for sending a saliva sample for confirmation testing involves: (i) either using a software application ("App"), or a website, to register the test with a database maintained by remote internet (online) means, and (ii) using accompanying postage to anonymously ship the testing device to a lab, or a third party recipient that would then forward the device to a laboratory.

Each testing kit may have a unique barcode associated with it that can be scanned using the app or registered via the accompanying number on the website.

The subject donor, or other person or entity, seeking or facilitating confirmation testing, would register the test using either the app or website, and physically send the device and preserved saliva sample to the laboratory or third party. In the case of a third party, it would then forward the device to an accredited laboratory, which would carry out the confirmation testing and send the results to a medical review officer (MRO).

Once the MRO verifies the findings, the official result is disseminated to the requester, for example it can be published online, so the person or company who registered the test can see it. This is all done anonymously.

This device and process together ensure that consumers and companies get the benefit of the convenience of an instant saliva test kit and the opportunity to have the results confirmed by laboratory testing.

Confirmation testing may provide results of the test, and possibly DNA confirmation to ensure the donor is the intended person.

The App

The App is configured to facilitate the registering and confirmation testing of the test kit and is designed to be as simple to use as possible. The process for registering a donor, and sending a testing kit for confirmation testing, is generally as follows:

The user (either an individual or company) logs in and creates a profile with minimal steps. (Profiles can be more robustly filled out later.)

They can follow along with a tutorial to immediately start using the App or skip it if they feel like they can intuitively learn how to use it on their own.

Using the camera, the account holder can scan the donor's identification to see if the donor is in a database. If the donor is already in the database, the app will link the test to the person's profile. If the donor is not yet in the database, the app will create a profile for the person and connect the test to their newly created profile.

The account holder can test one subject at a time or, if necessary, test multiple individuals in batches, connecting each person's scanned ID to their profile and test.

During the process of registering a test kit and a donor, users can choose which type of test it is, for example: how many drugs or drug metabolites are being tested for, and give the test a title to more easily record what the test is for (for example, a title with a date, or if it's a random test, pre-employment test or post-accident test, or other).

The App will also guide an individual through the process of reading the test results so they can learn how to do it and follow best practices. These educational screens can be skipped by those who may already know how to read test results.

The home page of the app may comprise three sections: (i) home—where one can initiate a new test registration or see past test results; (ii) university—where one can view the educational content about administering and reading tests; (iii) status—where one can view what stage pending test results are at.

The Website

Companies can register tests via the website by signing up for a corporate account.

The website and the App will use the same online portal for registering companies, individuals, donors and tests.

Via the website, a company can register their employees, connect tests to employees and arrange to have a testing kit shipped for laboratory confirmation.

The website can be used to provide an online system where one can use the test and then go to the website to register the test and use the online platform to anonymously send their test (via mail or courier) for confirmation.

Samples are received and processed. Dispatch is made to a laboratory and the lab will review the test and obtain a confirmation result. That test result and the test goes to a medical professional who reviews it to make sure there is no problem. The results get published online (only to those with secure access).

In this regard, consumers get the convenience of an instant test, but also get the benefit of being absolutely sure the results are accurate.

The online service can be provided for companies, not just individuals.

Options for Companies

Companies must be able to enter the employee's name.

Company obtains consent from employee. Donor agrees to send their sample to the lab.

Example: Urine and Saliva

Urine samples will be good for a few weeks, but saliva samples break down quickly, therefore, a separate saliva sample must be obtained and injected with a buffer. The disclosed device has a buffer stored in the lid. One can activate the buffer to drain into the sample, preserving it for an extended period and allowing for transportation to a lab. The half-life for drugs in saliva is so short that even if there are traces of drugs in the saliva, they may become undetectable in just a couple of days. In the buffer, the sample is good for up to a couple of weeks or more.

Certain disadvantages of using instant drug tests are that a collector is needed to observe the collection, a process of recording the collection. Most businesses don't have a real collection process for instant tests in an organized way. Most will either use paper forms that come with the tests, or they only send subjects who fail the instant tests to a collection center.

As saliva tests become increasingly popular, because you don't need special facilities, and they are nearly impossible to cheat, it may become easier for employers to send samples in for confirmation. Currently, two samples must be taken, a field-test and a separate confirmation test.

The App can be used for any instant test, even those provided by various manufacturers. The App will make collection easier for employers, as they can choose the test, scan the donor's ID card to get their information, and record the results.

Nobody is going to need a collector except for perhaps the first day (first sample). Eventually, everyone's DNA will be collected and registered with the database associated with the App, and the App will notify when it's time for a drug test.

Each device may comprise a unique barcode and ID number, or other indicia, so each one will be different and traceable. Users can take a photo or scan the barcode of the specific test they are using. If the result is positive, the subject will not be able to go back and change the ID number of the test they are using.

Blockchain.

Right now, when individuals are drug tested, it's usually some kind of legal entity who obtains the results and the individuals who are tested virtually never see the results of their test and have no way of obtaining the results.

If an individual seeks to prove they were not doing drugs years ago, there is no way to obtain the results from the drug tests they've undergone.

With the help of blockchain verification, all of the tests that are being done on subjects can be provided access to the tests they've undergone to be able to prove they were tested and the results of those tests. This can be useful for employment screening, court proceedings, and even insurance pricing, among other applications.

In this regard, one can verify that a particular result is independently correct, and that nobody has changed it using blockchain. If someone needs to share the result with another, they can do it using the described architecture.

Nicotine, alcohol and illicit drugs, among others, may be targets for the diagnostic tests.

Any range or device value given herein may be extended or altered without losing the effect sought, as will be apparent to the skilled person.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

When introducing elements of aspects of the disclosure or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of." The phrase "one or more of the following: A, B, and C" means "at least one of A and/or at least one of B and/or at least one of C."

Having described aspects of the disclosure in detail, it will be apparent that modifications and variations are possible without departing from the scope of aspects of the disclosure as defined in the appended claims. As various changes could be made in the above constructions, products, and methods without departing from the scope of aspects of the disclosure, it is intended that all matter contained in the above description and shown in the accompanying drawings shall be interpreted as illustrative and not in a limiting sense.

What is claimed is:

1. A system for use with a saliva collection device having a collection reservoir, the system comprising:

a base having a neck extending from the base;

a film-puncture element disposed within the neck wherein the neck is radially disposed around each portion of the film-puncture element, wherein the film-puncture element comprises one or more puncture points and further wherein the film-puncture element comprises a slot extending along a side of the film-puncture element, wherein the slot is configured to communicate at least a portion of the preservation buffer toward the one or more fluid ports;

one or more fluid ports extending through the base within the neck; and a cap engaged with an exterior of the neck, the cap comprising a film attached about an inner cylinder of the cap along a periphery thereof;

wherein the film defines a buffer-containing cavity within the cap, and wherein the buffer-containing cavity is configured to hold a preservation buffer for preserving a sample stored within the collection reservoir of the saliva collection device.

2. The system of claim 1, wherein the collection reservoir is removably coupled to the base of the device.

3. The system of claim 1, wherein the preservation buffer comprises: a detergent, a metal chelator, and a pH buffer.

4. The system of claim 1, wherein the preservation buffer comprises: sodium dodecyl sulfate, EDTA, and Tris.

5. The system of claim 1, wherein the film comprises a planar seal.

6. The system of claim 1, wherein the neck is integrally formed with the base.

7. The system of claim 1, wherein the cap and the film are concentrically aligned.

8. The system of claim 1, wherein the film-puncture element and the neck are concentrically aligned.

9. The system of claim 1, the base further comprising one or more flanges extending outwardly from the film-puncture element wherein the one or more flanges are configured to couple with the collection reservoir.

10. The system of claim 1, wherein the neck comprises a continuous annular formation.

11. The system of claim 1, wherein the film-puncture element is coupled to the base.

12. The system of claim 1, wherein the film-puncture element is configured to puncture the film.

13. The system of claim 1, wherein the cap is configured to encapsulate the neck.

14. The system of claim 1, wherein the base is removable from the collection reservoir of the saliva collection device.

15. The system of claim 1, wherein the film-puncture element is integrally formed with the base.

* * * * *